US007387172B2

(12) United States Patent
Vandeligt et al.

(10) Patent No.: US 7,387,172 B2
(45) Date of Patent: Jun. 17, 2008

(54) MODULAR SELF-PROPELLED DRILLING APPARATUS

(76) Inventors: Gerald J. Vandeligt, P.O. Box 66, Spirit River, Alberta (CA) T0H 3G0; Gerald J. Richard, P.O. Box 66, Spirit River, Alberta (CA) T0H 3G0

( * ) Notice: Subject to any disclaimer, the term of this patent is extended or adjusted under 35 U.S.C. 154(b) by 149 days.

(21) Appl. No.: 11/149,339

(22) Filed: Jun. 10, 2005

(65) Prior Publication Data

US 2006/0278418 A1 Dec. 14, 2006

(51) Int. Cl.
*E21C 11/02* (2006.01)

(52) U.S. Cl. ..... 173/184; 173/185; 173/25; 173/27; 173/28

(58) Field of Classification Search ..... 173/184, 173/185, 25, 27–28; 172/439, 47; 280/292
See application file for complete search history.

(56) References Cited

U.S. PATENT DOCUMENTS 3,435,908 A * 4/1969 Sunderlin et al. ..... 180/9.44
3,650,346 A * 3/1972 Desmarais et al. ..... 180/420
3,744,574 A 7/1973 Carley
3,767,329 A 10/1973 Houck
3,823,902 A 7/1974 Bumueller
3,981,485 A 9/1976 Eddy et al.
4,022,410 A * 5/1977 Ewart et al. ..... 248/647
4,192,393 A 3/1980 Womack et al.
4,303,130 A 12/1981 Bonca
4,363,519 A * 12/1982 Howard ..... 299/31
4,476,940 A 10/1984 Reichert et al.
4,632,194 A 12/1986 Averill et al.
4,784,439 A * 11/1988 Wrulich et al. ..... 299/57
4,944,649 A * 7/1990 Stralow ..... 414/686
5,363,925 A 11/1994 Gallagher
5,531,283 A * 7/1996 Austin et al. ..... 180/53.1
5,836,402 A 11/1998 Jones
5,954,143 A 9/1999 McCabe et al.
5,975,216 A * 11/1999 Gibbons ..... 172/439
6,152,244 A 11/2000 Rokbi (Continued)

FOREIGN PATENT DOCUMENTS

WO WO 90/12948 A1 11/1990

(Continued)

*Primary Examiner*—Rinaldi I. Rada
*Assistant Examiner*—Michelle Lopez
(74) *Attorney, Agent, or Firm*—Donald V. Tomkins

(57) ABSTRACT

An articulated, modular, track-mounted, self-propelled, remote-controlled drilling apparatus is demountable into several heli-transportable components, including a drilling module and a drill support module, plus separate hydraulically-driven track carriages on which they are removably mountable. The track carriages are demountably coupled in tandem by a tri-axially articulated hitch mechanism incorporating a track steering mechanism. The drilling module carries a rotary drill, a hydraulic pump operatively connected to the track drive mechanisms, and a primary motor, which selectively drives either the drill or the pump. The use of multiple demountable modules reduces the weight of the components to be heli-transported, thus allowing the use of smaller and more economical helicopters. The combination of self-propelled, track-mounted modules with tri-axial articulation and remote controllability enables the assembled apparatus to operate more easily over rough terrain than known seismic drills, reducing or eliminating the need for separate means for transporting the apparatus between borehole locations.

14 Claims, 3 Drawing Sheets

U.S. PATENT DOCUMENTS

| | | | | |
|---|---|---|---|---|
| 6,443,236 | B2 * | 9/2002 | Staude | 172/439 |
| 6,527,063 | B2 * | 3/2003 | Rust et al. | 175/162 |
| 6,681,470 | B1 | 1/2004 | Scott | |
| 2004/0031617 | A1 | 2/2004 | Skarlupka, IV et al. | |

FOREIGN PATENT DOCUMENTS

| | | |
|---|---|---|
| WO | WO 03/038231 A3 | 5/2003 |

* cited by examiner

MODULAR SELF-PROPELLED DRILLING APPARATUS

FIELD OF THE INVENTION

The present invention relates in general to apparatus for drilling into subsurface soil formations, and in particular relates to drilling apparatus that is transportable by helicopter.

BACKGROUND OF THE INVENTION

Drilling equipment for boring into subsurface formations is used in a variety of industrial applications. One particular application is in seismic drilling, which is commonly used in exploration for oil and gas. In seismic drilling, an explosive charge is detonated inside a borehole, and the resultant wave patterns generated in the soil structure in the vicinity of the borehole are recorded (or "logged") using special electronic equipment. The seismic logs are interpreted by specialists to identify subsurface zones where crude oil or natural gas may be present.

It is generally desirable for seismic drills to be self-propelled so that they can easily moved from one borehole site to another without need for separate means of transport. It is also desirable for seismic drills to be adapted for operation on uneven ground surfaces, particularly when used in hilly or mountainous areas. It is further desirable for seismic drills to be comparatively small in physical size so that they will be more easily maneuverable over rough terrain and in forested areas. It is further desirable for seismic drills to be remotely controllable, to eliminate the need for a riding operator who would be exposed to the risk of injury in the event of the drill overturning or other mishaps which are particularly more likely to occur when operating in rough terrain.

Seismic drilling operations are commonly carried out in remote areas that are not accessible by roads, thus preventing the use of large truck-mounted seismic drilling equipment. It is well known, in such situations, to use drilling rigs that can be flown to the drilling site by helicopter (and therefore may be referred to as "heli-transportable" drills). The cost of transporting equipment by helicopter increases with the weight of the equipment and the size or type of helicopter being used. Accordingly, it is desirable to keep the weight of heli-transportable drilling equipment as low as possible in order for heli-transport to be economically feasible.

The ideal seismic rig for use in remote locations and rough terrain would incorporate all of the foregoing features, while still having the ability to drill seismic boreholes efficiently and to considerable depths.

Many of these desirable features can be individually found in the prior art. Examples of heli-transportable drills may be seen in U.S. Pat. No. 3,767,329 (Houck), U.S. Pat No. 3,981,485 (Eddy), U.S. Pat No. 4,192,393 (Womack), and U.S. Pat No. 4,476,940 (Reichert). However, none of these drills are self-propelled. The Houck drill is demountable for heli-transport, but its components weigh as much as 4,000 pounds, necessitating the use of a comparatively large helicopter and entailing correspondingly high helicopter operating costs.

Self-propelled drill rigs are well known, as are rigs that are articulated and/or track-mounted to facilitate travel over rough terrain. For example, U.S. Pat. No. 3,744,574 (Carley) discloses an articulated, self-propelled, wheel-mounted rock drill. U.S. Pat. No. 6,152,244 (Rokbi) discloses an articulated wheel-mounted drill. Examples of prior art track-mounted drills include U.S. Pat. No. 3,289,779 (Feucht) and U.S. Pat. No. 3,478,832 (Hughes). Each of the foregoing prior art drills is comparatively large and heavy, and neither adapted nor readily adaptable for transport by helicopter.

What is needed, therefore, is a self-propelled seismic drill that is adapted for efficient operation over rough or uneven terrain, and that can be transported by smaller helicopters than known heli-transportable drills. The present invention is directed to these needs.

BRIEF DESCRIPTION OF THE INVENTION

In general terms, the present invention is an articulated, modular, track-mounted, self-propelled, remote-controlled drilling apparatus demountable into separate components to facilitate transport by helicopter. These components include front and rear track carriages, which are connected in tandem by an articulated hitch means that provides for articulation about all three axes. The articulated hitch means also incorporates track carriage steering means. The track carriages are constructed in accordance with known technology, with each carriage having a pair of crawler tracks which provide enhanced traction and maneuverability over rough or uneven surfaces. The front track carriage has a longitudinal axis parallel to and midway between the crawler tracks of the front track carriage. Similarly, rear track carriage has a longitudinal axis parallel to and midway between the crawler tracks of the rear track carriage. The track carriages have separate hydraulic drive systems of known type, adapted for cooperative operation. The track drive systems and track carriage steering mechanism are remotely controlled, using known remote control technology, thus eliminating the need to provide an operator's seat and operator's drive and steering controls, with corresponding savings in equipment weight.

The rear track carriage is adapted for demountably carrying a drilling module, the main sub-components of which are a rotary drill mechanism, a primary motor, and a hydraulic pump. The primary motor (preferably a 4-cylinder diesel motor) is adapted to provide power to both the rotary drill and the hydraulic pump, which in turn serves the hydraulic drive systems of the track carriers. Means are provided whereby the motor can be selectively switched between drill drive mode and pump drive mode.

The front track carrier is adapted for demountably carrying a drill support module, the sub-components of which may vary depending on the nature of the drilling operations to be conducted. Seismic drilling is commonly carried out using either water or compressed air. When boreholes are being drilled in cohesive soils such as clay and shale, water is introduced into the borehole (typically via the drill stem) to lubricate the drill bit and to assist in removal of drill cuttings. However, this is less effective (or not effective at all) when drilling in non-cohesive soils such as gravel, in which case it may be necessary or desirable to inject compressed air (via the drill stem) to blow cuttings out of the borehole via the annulus between the drill stem and the borehole. Compressed air is also commonly used when drilling through rock formations or large boulders, which typically entails the use of air hammers to break up the rock.

Accordingly, the drill support module in one embodiment of the invention will primarily comprise a water storage tank, which preferably will have a storage capacity in the range of 200 Imperial gallons. In an alternative embodiment, the drill support module will comprise an air compressor with a dedicated power unit (preferably a small diesel motor). The drill support module in this embodiment may also have a small water tank to provide for situations where drilling will be primarily air-assisted but may require the use of water to drill through localized zones of cohesive material. Flexible water hoses or air hoses are provided, as appropriate, to convey water or compressed air to the drill.

The use of multiple demountable modules, as described above, makes it possible to reduce the weight of individual components of the apparatus to approximately 1,850 pounds or less, thus allowing the use of helicopters than are considerably smaller and more economical to operate than those typically required for known heli-transportable drills. As well, the use of a pair of track carriages reduces the necessary physical size of each carriage, thus enhancing maneuverability. The combination of self-propelled, track-mounted modules with tri-axial articulation and remote controllability enables the assembled apparatus to traverse rough and steep terrain more easily and with greater stability than known self-propelled seismic drill units such as the four-wheel-drive quad units and six-wheeled or eight-wheeled "argos" commonly used in seismic operations. The drilling apparatus of the present invention thus can readily move on its own power between borehole locations, considerably reducing or eliminating the need for separate means (such as a helicopter) for transporting the apparatus between borehole locations.

Accordingly, in a first aspect the present invention is a modular, self-propelled, articulated drilling apparatus comprising:

(a) a front track carriage having a front end, a rear end, a longitudinal axis, and a hydraulic drive system;

(b) a rear track carriage having a front end, a rear end, a longitudinal axis, and a hydraulic drive system;

(c) a drill support module removably mountable on the front carriage;

(d) a drilling module removably mountable on the rear carriage;

(e) tri-axially articulated hitch means for demountably coupling the front and rear track carriages; and (f) steering means associated with the articulated hitch means;

wherein the drilling module comprises:

(g) rotary drill apparatus;

(h) a hydraulic pump, for driving the hydraulic drive systems of the front and rear track carriages;

(i) a primary motor; and (j) motor control means, for selectively switching the primary motor between a first mode in which the primary motor drives the rotary drill apparatus, and a second mode in which the primary motor drives the hydraulic pump.

In a second aspect, the invention is a tri-axially articulated hitch mechanism for demountably coupling a first mobile equipment unit to a second mobile equipment unit, said hitch mechanism comprising:

(a) first and second hitch sections, each having an inner end and an outer end, said first and second hitch sections being swivellably connected near their inner ends about a swivel axis;

(b) first axle-mounting means mounted to the outer end of the first hitch section; and (c) second axle-mounting means mounted to the outer end of the second hitch section so as to be pivotable relative to the second hitch section about a pivot axis intercepting the swivel axis;

wherein:

(d) the first axle means is hingeingly mountable to a first equipment unit such that the first equipment unit is hingeable relative to the first axle means about a hinge axis transverse to the longitudinal axis of the first equipment unit; and (e) the second axle means is hingeingly mountable to a second equipment unit such that the second equipment unit is hingeable relative to the second axle means about a hinge axis transverse to the longitudinal axis of the second equipment unit.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
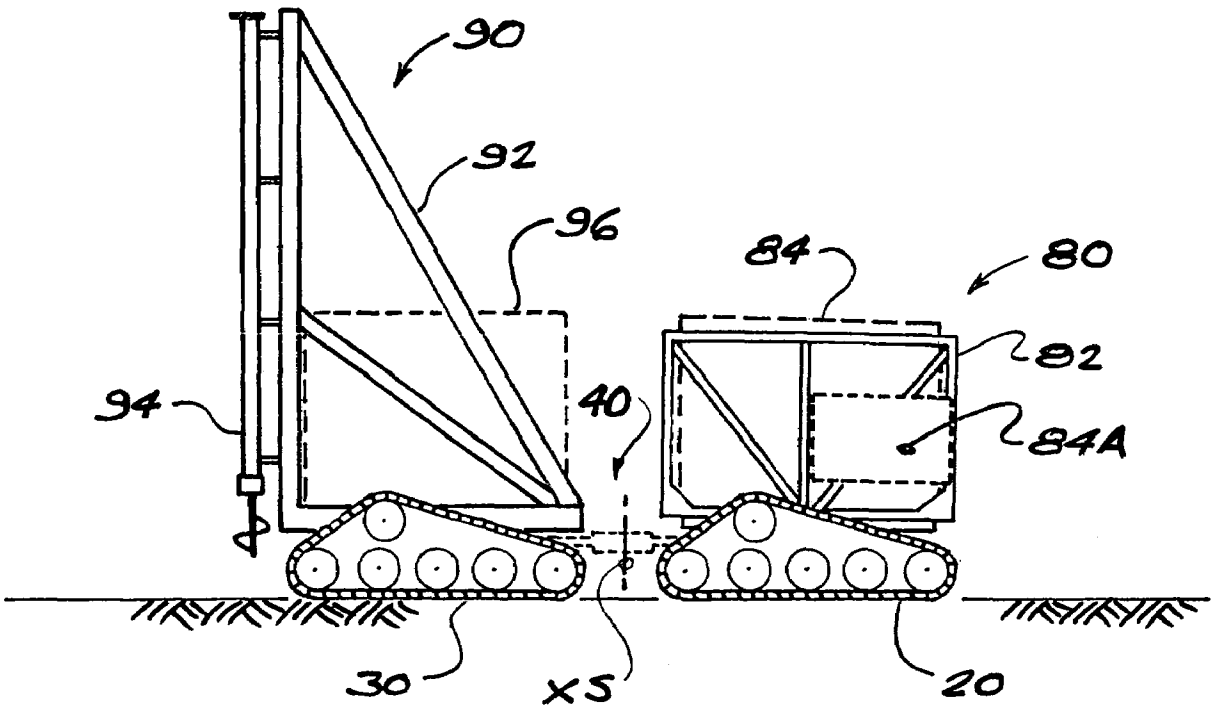
FIG. 1 is an elevation of a modular drilling apparatus in accordance with one embodiment of the invention.

Referring to FIG. 1, the drilling apparatus of the present invention (generally indicated by reference number 10) comprises a front track carriage 20, a rear track carriage 30, an articulated hitch mechanism 40 (by means of which front track carriage 20 and rear track carriage 30 may be demountably coupled), a drill support module 80 which is removably mountable upon front carriage 20, and a drilling module 90 which is removably mountable upon rear carriage 30. It should be noted that the reference to the track carriages as "front" and "rear" carriages is for convenience only, and is not intended to be limiting in terms of the configuration or direction of travel or in any other way (although it will perhaps be usual for rear carriage 30 to trail front carriage 20 when drilling apparatus 10 is in self-propelled transit). Front carriage 20 and rear carriage 30 have individual hydraulic drive systems, which may be of any suitable known type. Front carriage 20 and rear carriage 30 are cooperatively engageable by means of the hitch mechanism 40, which allows for tri-axial articulation as will be described in further detail herein.

Drilling module 90 includes a structural frame 92 adapted to support a rotary drill apparatus 94, and to carry equipment (conceptually represented by block 96 in FIG. 1) including a primary motor and a hydraulic pump. Structural frame 92 is adapted so as to be removably mountable to rear track carriage 30. Structural frame 92 of drilling module 90 is conceptually shown in FIG. 1 as an open framework, but this is for exemplary illustrative purposes only; structural frame 92 may be of any suitable construction and configuration.

The primary motor is adapted to selectively drive the drill apparatus 94 or the hydraulic pump, which in turn is operatively engageable with the hydraulic drive systems of the front track carriage 20 and the rear track carriage 30. The primary motor may be of any suitable type (for example, a 4-cylinder diesel motor). Ancillary equipment 96 includes motor control means (not shown) whereby the output of the primary motor can be selectively directed to driving drill apparatus 94 when a borehole is being drilled, or to driving the hydraulic pump so as to power the hydraulic drive systems of track carriages 20 and 30 when the apparatus 10 is in transit between borehole locations. Persons skilled in the art of the invention will readily appreciate that various types or configurations of motor control means suitable for this purpose may be devised in accordance with technology well known in the field. Preferably, the motor control means is electronically controlled.

Drill support module 80 includes a structural frame 82 adapted to carry ancillary equipment (conceptually represented by block 84 in FIG. 1) needed or desired to support the operation of drill apparatus 94. Structural frame 82 of drill support module 80 is conceptually shown in FIG. 1 as an open framework, but this is for exemplary illustrative purposes only; structural frame 82 may be of any suitable construction and configuration.

The ancillary equipment 84 carried by drill support module 80 may vary depending on the nature of the drilling operations involved, and the subsurface soil conditions at the drilling site. In one embodiment of drill support module 80, ancillary equipment 84 includes a water storage tank, which preferably will have a storage capacity in the range of 200 Imperial gallons. This configuration of drill support module 80 may be desirable when drilling through cohesive soils, as previously described. Flexible water hoses (not shown) are also provided, to convey water from the storage tank to drill apparatus 94.

In an alternative embodiment, ancillary equipment 84 of drill support module 80 includes art air compressor with a dedicated power unit (for example, a small diesel motor). This alternative configuration of drill support module 80 may he desirable when drilling through non-cohesive soils, such as gravel, or when drilling through rock formations or large boulders. Flexible air hoses (not shown) are provided for delivering compressed air from the compressor to drill apparatus 94. The drill support module 80 irk this alternative embodiment may also have a small water tank (conceptually indicated in FIG. 1 by reference number 84A) to provide for drilling conditions in which the use of both compressed air and water may be beneficial.

Figure 2:
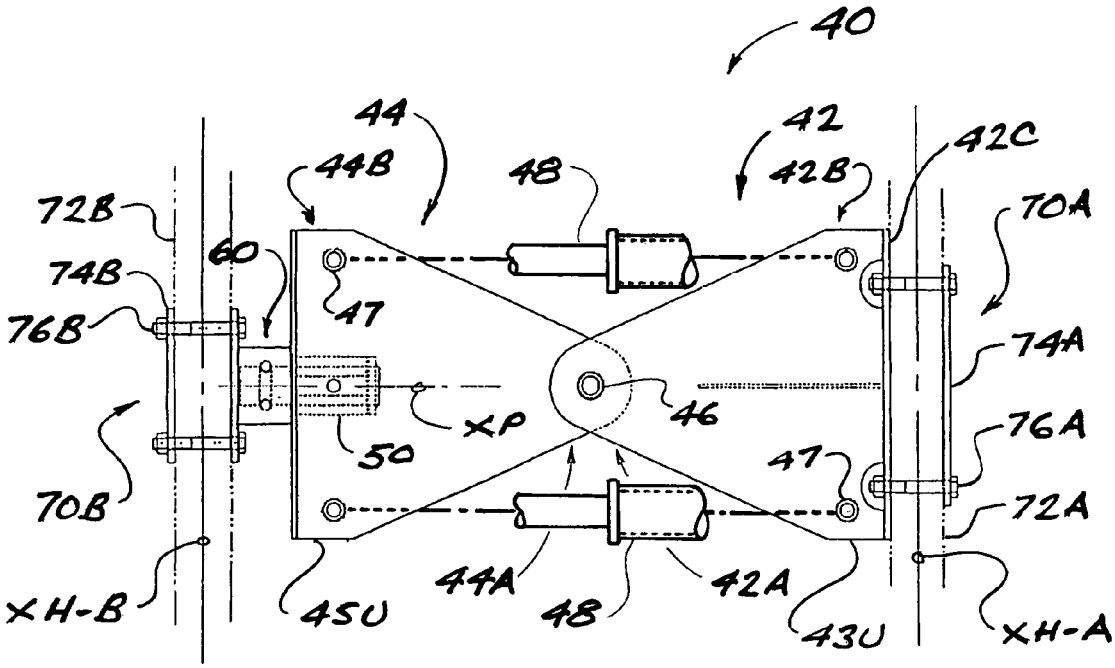
FIG. 2 is a plan view of the articulated hitch mechanism of the drilling apparatus in accordance with the preferred embodiment.

Hitch mechanism 40 couples front track carriage 20 and rear track carriage 30 such that they can articulate relative to each other about three axes. This articulation capability can be best understood from FIGS. 2 and 3, which illustrate a preferred embodiment of the articulating hitch mechanism 40. Hitch mechanism 40 comprises a a first hitch section 42 and a second hitch section 44, each of which has an inner end (42A, 44A) and an outer end (42B, 44B). In the preferred embodiment, first hitch section 42 comprises an upper plate 43U and a lower plate 43L, and second hitch section 44 comprises an upper plate 45U and a lower plate 45L, said upper and lower plates of each hitch section being spaced apart from each other. As shown in FIG. 2, plates 43U, 43L, 45U, and 45L are of generally triangular configuration in the preferred embodiment, but this is not essential to the invention. Nor is it essential that either first hitch section 42 or second hitch section 44 be fabricated with plates; the hitch sections may take various other forms of construction (such as an open structural framework, to give only one example) without departing from the concept of the invention.

Figure 3:
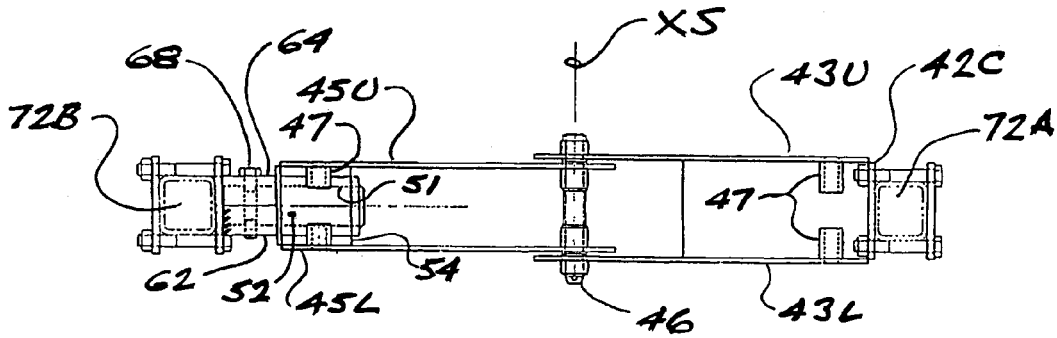
FIG. 3 is a side view of the articulated hitch mechanism of FIG. 2.

Hitch sections 42 and 44 are swivellably connected about a swivel axis XS in the vicinity of their respective inner ends 42A and 44A, using a swivel pin 46 of any suitable type. Hitch mechanism 40 includes steering means, for controlling articulation about swivel axis XS and thus effectively controlling the direction of travel of the drilling apparatus 10 when in transit under its own power. In the preferred embodiment of the invention, the steering means comprises a pair of hydraulic cylinders 48 disposed one on either side of swivel axis XS, each cylinder 48 being rotatably connected at one end to hitch section 42 near its outer end 42B and at the other end to hitch section 44 near its outer end 44B, all as illustrated in FIG. 2. As shown in FIGS. 2 and 3, hitch sections 42 and 44 may be provided with cylinder bosses 47 to facilitate mounting of hydraulic cylinders 48.

Hydraulic cylinders 48 are operably connected in well-known fashion to the hydraulic pump of drilling module 90 (or, in alternative embodiments, to a dedicated steering pump) by means of suitable flexible hydraulic fluid conduits (not shown). Hydraulic cylinders 48 preferably will be double-acting cylinders, but single-acting cylinders may be used in alternative embodiments.

In the preferred embodiment of the invention, the operation of the primary motor and hydraulic pump of drilling apparatus 10 are remotely and electronically controlled with respect to both track-drive functions and steering functions. The remote control function may be provided using a remote control station linked to drilling apparatus 10 by means of a control cable or by a wireless communication link, in accordance with methods and technology well known to persons skilled in the field of the invention.

Hitch mechanism 40 also includes first axle-mounting means 70A which is mounted to first hitch section 42 at the outer end 42B thereof, generally as shown in FIGS. 2 and 3. First axle-mounting means 70A is adapted to connect to a first axle means (conceptually indicated by reference number 72A) which in turn is mounted to first track carriage 20 such that first track carriage 20 is hingeingly rotatable about a hinge axis XH-A transverse to the longitudinal axis of first track carriage 20. As shown in FIGS. 2 and 3, first axle means 72A may comprise a square (or round) tubular member, which has the benefit of providing torsional strength while being comparatively light in weight. The tubular member may be rotatably connected to first track carriage 20 by means of suitable shafts and bearings (not shown) in accordance with well-known methods. However, this preferred arrangement for first axle means 72A is not essential to the invention; persons skilled in the field of the invention will readily appreciate that first axle means 72A and its hingeing connection to first track carriage 20 may take a variety of other forms in accordance with known technology.

As illustrated in FIGS. 2 and 3, first axle-mounting means 70A may be provided in the form of a clamp plate 74A by which first axle means 72A may clamped to outer end 42B of first hitch section 42 using clamp bolts 76A that engage an end plate 42C provided at outer end 42B of first hitch section 42. However, this arrangement is exemplary only, and various other configurations of first axle-mounting means 70A may be devised without departing from the present invention.

Second hitch section 44 includes a pivot pin housing 50 disposed between the upper and lower plates 44U and 44L of second hitch section 44. Pivot pin housing 50 has a cylindrical pivot pin bore 51 for receiving a pivot pin. As shown in FIG. 3, pivot pin housing 50 may be in the form of a round pipe 52 with spacers 54 as necessary to facilitate connection to upper and lower plates 44U and 44L (such as by welding). Pivot pin housing 50 is oriented such that the axis or pivot pin bore 51 (which may be referred to as pivot axis XP) is preferably (but not necessarily) substantially perpendicular to swivel axis XS and intercepts swivel axis XS. It is preferable if pivot axis XP intercepts swivel axis XS with close to geometrical precision, but this is not critical. The desirability of having pivot axis XP intercept swivel axis XS lies in avoiding eccentricity in the transfer of longitudinal forces between front track carriage 20 and rear track carriage 30, but drilling apparatus 10 can function satisfactorily even if hitch mechanism 40 incorporates some amount of longitudinal eccentricity. Accordingly, the phrase "intercepts the swivel axis" and contextually similar phrases in this patent document are not intended to be restricted to the case where pivot axis XP intercepts swivel axis XS with geometrical precision, but also cover cases where pivot axis XP to one side of, but reasonably close to, swivel axis XS.

Figures 4A, 4B:
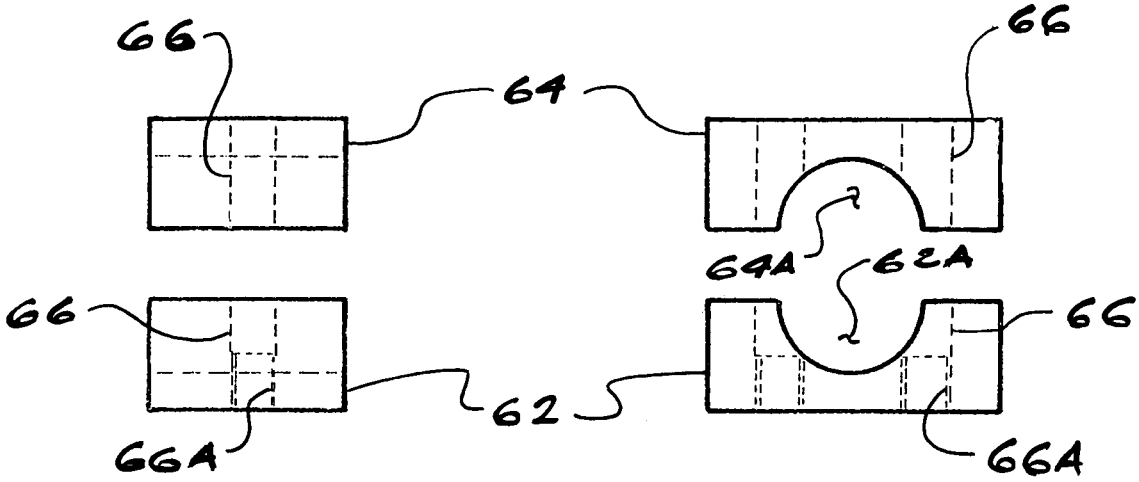
FIG. 4A is an exploded side view of a pivot block assembly for use with the hitch mechanism of FIG. 2.
FIG. 4B is an exploded end view of a pivot block assembly for use with the hitch mechanism of FIG. 2.

Hitch mechanism 40 also includes a second axle-mounting means 70B for receiving a second axle means 72B mounted to second track carriage 30 such that second track carriage 30 is hingeingly rotatable about a hinge axis XH-B transverse to the longitudinal axis of second track carriage 30. The details of second axle-mounting means 70B and its connection to second track carriage 30 are generally as described previously with respect to first axle means 72A, with the exception that second axle-mounting means 70B is mounted to second hitch section 44 so as to be pivotable about pivot axis XP. This feature is provided in the preferred embodiment by means of a split pivot block 60 comprising a first pivot block section 62 and a second pivot block section 64, which are illustrated in FIGS. 4A and 4B. First pivot block section 62 defines a semi-cylindrical cavity 62A, and second pivot block section 64 defines a semi-cylindrical cavity 64A having the same diameter as cavity 62A.

Second pivot block section 64 is matingly engageable with first pivot block section 62 such that semi-cylindrical cavities 62A and 64A combine to form a cylindrical pivot block passage 65. First pivot block section 62 and second pivot block section 64 are provided with means for releasably securing second pivot block section 64 to first pivot block section 62. In the embodiment illustrated in FIGS. 2, 3, 4A, and 4B, this securing means is provided in the form of fastener holes 66 for receiving fasteners 68. Fastener holes 66 may be straight holes passing fully through pivot block sections 62 and 64 for receiving through-bolts, or they may incorporate threaded sections 66A for receiving machine screws. Other suitable means of releasably securing second pivot block section 64 to first pivot block section 62 will be readily apparent to persons skilled in the art.

First pivot block section 62 is securely connected to second axle-mounting means 70B (such as by welding), with the axis of pivot block passage 65 oriented substantially perpendicular to hinge axis XH-B. Second axle-mounting means 70B may now be pivotably mounted to second hitch section 44 using a pivot pin 67 disposed within both pivot pin bore 51 of pivot pin housing 50 and pivot block passage 65 of assembled pivot block 60, so as to be rotatable about pivot axis XP while at the same time being retained longitudinally within pivot pin housing 50 and the assembled pivot block 60.

Figure 5:
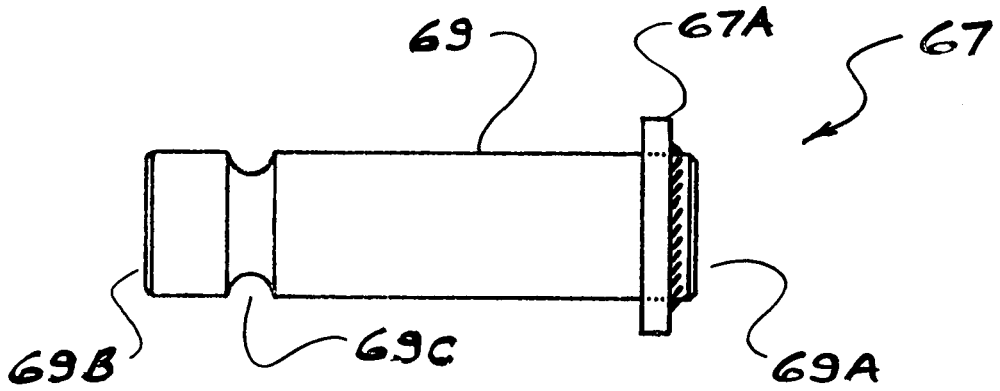
FIG. 5 is a side view of a pivot pin for use with the hitch mechanism of FIG. 2.

In the illustrated preferred embodiment of the invention, the diameters of pivot pin bore 51 and pivot block passage 65 are equal, and pivot pin 67 comprises a round shaft 69 having a diameter slightly smaller than that of pivot pin bore 51 and pivot block passage 65, such that pivot pin 67 will be freely rotatable within pivot pin bore 51 and pivot block passage 65. Round shaft 69 has an inner end 69A and an outer end 69B, and has a stop member 67A (such as an annular ring as in FIG. 5, or any other suitable appurtenance or attachment accomplishing the desired function) at or near inner end 69A. An annular groove 69C is formed in shaft 69 near outer end 69B.

As best seen in FIGS. 2 and 3, pivot pin 67 may be inserted through pivot pin bore 51 such that outer end 69B of shaft 69 projects beyond outer end 44B of second hitch section 44. The projecting outer end 69B of shaft 69 may then be disposed within semi-cylindrical cavity 62A of first pivot block section 62, whereupon second pivot block section 64 may be engaged with and fastened to first pivot block section 62 as previously described. As a result of this assembly, the axis of pivot pin 67 will coincide with pivot axis XP. In the illustrated embodiment, fastener holes 66 of first and second pivot block sections 62 and 64 are configured such that fasteners 68, when inserted through fastener holes 66, will at least partly intercept annular groove 69C of shaft 69 when said annular groove 69C is longitudinally aligned, with fastener holes 66. By means of this arrangement, fasteners 68 will retain pivot pin 67 longitudinally within pivot block passage 65 while still allowing pivot pin 67 to rotate about pivot axis XP within pivot block passage 65. Pivot pin 67 is longitudinally retained within pivot pin housing 50 by means of stop member 67A, which abuts the inner end of pivot pin housing 50 when hitch mechanism 40 is assembled as seen in FIGS. 2 and 3.

Although pivot pin 67 has been described and illustrated in the simple form of a round bar of uniform diameter with an annular groove for retention within pivot block 60, persons skilled will recognize that pivot pin 67 may take other forms and configurations while still having the functional features described herein. For example, pivot pin 67 could have sections of different diameters, with pivot pin bore 51 and pivot block passage 65 having correspondingly different diameters. Longitudinal retention of pivot pin 67 within pivot pin housing 50 and pivot block 60 may be provided by other means as well. For example, semi-cylindrical cavities 62A and 64A could be formed with annular ridges that are matingly engageable with annular groove 69C of pivot pin 67. In an analogous alternative embodiment, pivot pin 67 could be formed with an annular ridge matingly engageable with annular grooves formed into semi-cylindrical cavities 62A and 64A. These exemplary alternative embodiments would eliminate the need for fasteners 68 to serve as longitudinal retention means, thus providing additional options with respect to the releasable connection of first pivot block section 62, to second pivot block section 64.

In the preferred embodiment, hitch mechanism 40 is provided with limiting means (not shown) for limiting the range of swivelling, pivoting, and hingeing movement about the swivel, pivot, and hinge axes respectively. The limiting means may be provided in the form of stop members, straps, cables, or suitable appurtenances of other types which may be readily devised by persons skilled in the field of the invention.

It will be readily appreciated by those skilled in the art that various modifications of the present invention may be devised without departing from the essential concept of the invention, and all such modifications are intended to be included in the scope of the claims appended hereto. By way of example (and without intending to limit the foregoing statement), first axle-mounting means 70A could be pivotably mounted to first hitch section 42 in addition to or instead of second axle-mounting means 70B being pivotably mounted to second hitch section 44. In another exemplary variant of the invention, the pivot pin may be non-rotatably connected to first hitch section 42 or second hitch section 44, such that it only rotates within pivot block passage 65.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. A modular, self-propelled, articulated drilling apparatus comprising:

(a) a front track carriage having a front end, a rear end, a longitudinal axis, and a hydraulic drive system;

(b) a rear track carriage having a front end, a rear end, a longitudinal axis, and a hydraulic drive system;

(c) a drill support module removably mountable on the front carriage;

(d) a drilling module removably mountable on the rear carriage;

(e) tri-axially articulated hitch means for demountably coupling the front and rear track carriages, said articulated hitch means comprising:

e.1 first and second hitch sections, each having an inner end and an outer end, said first and second hitch sections being swivellably connected near their inner ends about a swivel axis;

e.2 first axle-mounting means mounted to the outer end of the first hitch section; and e.3 second axle-mounting means, said second axle-mounting means being mounted to the outer end of the second hitch section so as to be pivotable relative to the second hitch section about a pivot axis intercepting the swivel axis;

wherein:

e.4 a first axle means is mountable to the front end of the rear track carriage such that the rear track carriage is hingeable relative to the first axle means about a hinge axis transverse to the longitudinal axis of the rear track carriage; and e.5 a second axle means is mountable to the rear end of the front track carriage such that the front track carriage is hingeable relative to the second axle means about a hinge axis transverse to the longitudinal axis of the front track carriage;

e.6 the first and second hitch sections each comprise an upper plate plus a lower plate disposed below and spaced apart from the upper plate, said upper and lower plates each having a swivel pin opening coaxial with the swivel axis;

e.7 the upper and lower plates of the first hitch section are swivellingly interconnected by means of a swivel pin disposed through the swivel pin openings of the upper and lower plates of the first and second hitch sections;

e.8 the second hitch section further comprises a pivot pin housing disposed between the upper and lower plates of the second hitch section adjacent the outer end of the second hitch section, said pivot pin housing defining a pivot pin bore concentric with the pivot axis;

e.9 the apparatus further comprises a pivot block assembly comprising:

e.9A a first pivot block section fixedly connected to the second axle-mounting means and oriented toward the second hitch section, said first pivot block having a substantially semi-cylindrical pivot pin recess concentric with the pivot axis;

e.9B a second pivot block section having a substantially semi-cylindrical pivot pin recess, said second pivot block section being releasably engageable with the first pivot block section such that their pivot pin recesses combine to form a cylindrical pivot block passage concentric with the pivot axis;

e.9C a pivot pin having an inner end and an outer end, and being adapted for insertion and rotation within the pivot pin bore and the pivot block passage; and e.9D means for restricting longitudinal displacement of the pivot pin within the pivot pin bore and the pivot block passage, without impeding rotation of the pivot pin; and (f) steering means associated with the articulated hitch means;

wherein the drilling module comprises:

(g) rotary drill apparatus;

(h) a hydraulic pump, for driving the hydraulic drive systems of the front and rear track carriages;

(i) a primary motor; and (j) motor control means, for selectively switching the primary motor between a first mode in which the primary motor drives the rotary drill apparatus, and a second mode in which the primary motor drives the hydraulic pump.

2. The drilling apparatus, of claim 1 wherein the motor control means is electronically controlled.

3. The drilling apparatus of claim 1, further comprising remote control means for remotely controlling the steering means and the motor control means.

4. The drilling apparatus of claim 1 wherein the remote control means comprises a control station linked to the drilling apparatus by a control cable.

5. The drilling apparatus of claim 1 wherein the remote control means comprises a control station adapted for wireless communication with the drilling apparatus.

6. The drilling apparatus of claim 1 wherein the front track carriage, the rear track carriage, the drill support module, and the drilling module each have a weight not exceeding approximately 1,850 pounds.

7. The drilling apparatus of claim 1 wherein the drill support module comprises a water storage tank.

8. The drilling apparatus of claim 1 wherein the drill support module comprises an air compressor and a compressor motor.

9. The drilling apparatus of claim 8, wherein the drill support module further comprises a water storage tank.

10. The drilling apparatus of claim 1 wherein the articulated hitch means comprises:

(a) first and second hitch sections, each having an inner end and an outer end, said first and second pivot sections being swivellably connected near their inner ends about a swivel axis;

(b) first axle-mounting means mounted to the outer end of the first hitch section so as to be pivotable relative to the first hitch section about a pivot axis intercepting the swivel axis; and (c) second axle mounting means mounted to the outer end of the second hitch section;

wherein:

(d) a first axle means is mountable to the front track carriage such that the front track carriage is hingeable relative to the first axle means about a hinge axis transverse to the longitudinal axis of the front track carriage; and (e) a second axle means is mountable to the rear track carriage such that the rear track carriage is hingeable relative to the second axle means about a hinge axis transverse to the longitudinal axis of the rear track carriage.

11. The drilling apparatus of claim 1 wherein the articulated hitch means comprises:

(a) first and second hitch sections, each having an inner end and an outer end, said first and second hitch sections being swivellably connected near their inner ends about a swivel axis;

(b) first axle-mounting means mounted to the outer end of the first hitch section so as to be pivotable relative to the first hitch section about a pivot axis intercepting the swivel axis; and (c) second axle-mounting means mounted to the outer end of the second hitch section so as to be pivotable relative to the second hitch section about a pivot axis intercepting the swivel axis;

wherein:

(d) a first axle means is mountable to the front end of the rear track carriage such that the rear track carriage is hingeable relative to the first axle means about an axis transverse to the longitudinal axis of the rear track carriage; and (e) the second axle means is mountable to the rear end of the front track carriage such that the front track carriage is hingeable relative to the second axle means about a hinge axis transverse to the longitudinal axis of the front track carriage.

12. The drilling apparatus of claim 1 wherein the track carriage steering means comprises a pair of hydraulic rams disposed on opposite sides of the swivel axis, each ram being pivotably connected at one end to the first hitch section and at the other end to the second hitch section, said rams being operatively connected to the hydraulic pump such that the first hitch section may be rotated relative to the second hitch section about the swivel axis by extending one ram and retracting the other ram, in cooperative fashion.

13. The drilling apparatus of claim 1 wherein:

(a) the pivot pin has a stop member mounted to the pivot pin near its inner end;

(b) the pivot pin has an annular groove near its outer end;

(c) the first pivot block section has a pair of locking pin passages one on either side of the pivot axis and oriented substantially transverse thereto, each said locking pin passage at least partially intersecting the pivot pin recess of the first pivot block section; and (d) the second pivot block section has a pair of locking pin passages, one on either side of the pivot axis and oriented substantially transverse thereto, each locking pin passage at least partially intersecting the pivot pin recess of the second pivot block section, and said locking pin passages of the second pivot block section being aligned with the locking pin passages of the first pivot block section;

wherein:

(e) the outer end of the pivot pin may be inserted through the pivot pin bore of the pivot pin housing so as to project beyond the outer end of the second hitch section;

(f) the projecting outer end of the pivot pin may be positioned in the pivot pin recess of the first pivot block section, with the annular groove of the pivot pin substantially aligned with the locking pin passages of the first pivot block section, whereupon the second pivot block section may be engaged with the first pivot block section; and (g) a pair of locking pins may be disposed within the locking pin passages of the first and second pivot block sections, such that:

g.1 the locking pins releasably connect the first and second pivot block sections; and g.2 the locking pins intercept the annular groove of the pivot pin, thus providing the means for restricting longitudinal displacement of the pivot pin.

14. The drilling apparatus of claim 1, further comprising limiting means for limiting the range of swivelling, pivoting, and hingeing movement about the swivel, pivot, and hinge axes respectively.

* * * * *